US007676958B2

(12) United States Patent
Cavasin

(10) Patent No.: US 7,676,958 B2
(45) Date of Patent: Mar. 16, 2010

(54) SKI BOOT

(75) Inventor: Massimo Cavasin, Montebelluna (IT)

(73) Assignee: Roces S.R.L., Montebelluna (IT)

( * ) Notice: Subject to any disclaimer, the term of this patent is extended or adjusted under 35 U.S.C. 154(b) by 973 days.

(21) Appl. No.: 11/376,216

(22) Filed: Mar. 16, 2006

(65) Prior Publication Data

US 2006/0230638 A1 Oct. 19, 2006

(30) Foreign Application Priority Data

Apr. 18, 2005 (IT) ..... TV2005A0053

(51) Int. Cl.
*A43B 5/00* (2006.01)

(52) U.S. Cl. ..... 36/117.1; 36/117.3; 36/118.2

(58) Field of Classification Search ..... 36/97, 36/117.1, 117.3, 118.2
See application file for complete search history.

(56) References Cited

U.S. PATENT DOCUMENTS

| | | | | |
|---|---|---|---|---|
| 6,450,510 | B1 | 9/2002 | Liu | |
| 7,314,222 | B2 * | 1/2008 | Borel et al. | 280/11.26 |
| 2002/0069557 | A1 * | 6/2002 | Miller et al. | 36/97 |
| 2003/0106244 | A1 * | 6/2003 | Miller et al. | 36/97 |
| 2003/0192204 | A1 * | 10/2003 | Miller et al. | 36/97 |
| 2004/0211090 | A1 * | 10/2004 | Miller et al. | 36/97 |
| 2005/0050772 | A1 * | 3/2005 | Miller et al. | 36/97 |
| 2005/0115113 | A1 * | 6/2005 | Miller et al. | 36/97 |
| 2005/0115114 | A1 * | 6/2005 | Miller et al. | 36/97 |

FOREIGN PATENT DOCUMENTS

| | | | |
|---|---|---|---|
| CH | 677 313 | A5 | 5/1991 |
| EP | 0 074 513 | A | 3/1983 |
| EP | 317764 | A2 * | 5/1989 |
| EP | 0 955 074 | A | 11/1999 |
| EP | 1 428 443 | A | 6/2004 |

* cited by examiner

*Primary Examiner*—Marie Patterson
(74) *Attorney, Agent, or Firm*—Modiano & Associati; Albert Josif; Daniel J. O'Byrne

(57) ABSTRACT

A ski boot comprising a conventional rigid sole from which there protrudes, from the area of the forefoot and approximately up to the area of the arch of the foot, a shell open in the direction of the area of the heel of the sole, thereat and to which there is rearwardly and slideably connectable a buttress element interacting with adjustment and guiding elements of the axial position with respect to the sole and to which a height-adjustable cuff is rotatably connectable.

23 Claims, 5 Drawing Sheets

SKI BOOT

The present invention relates to a ski boot.

BACKGROUND OF THE INVENTION

Presently there are in use ski boots constituted by a shell to which there is downwardly connected a sole, having a tip and a heel connectable to predisposed bindings fixed to a ski; the shell, usually provided in rigid or semi-rigid plastic material, covers approximately entirely the foot of the user.

To the shell there is rotatably connected, typically at the malleoli area, a cuff, adapted to partially cover the leg of the user to provide a support thereto during skiing.

Internally to the shell and to the cuff there is typically positioned an inner boot, provided in soft material, adapted to increase the comfort-fit for the user.

The main drawback of such known ski boots is that they must be produced, for being adequate to the size of the foot of the user, in various dimensions: this increases production costs, there being necessary different machines and molds for producing the components in the different dimensions, and moreover there exists the problem of stocking the various sizes, for both the producer and for the seller.

As a possible solution to such drawback ski boots are usually produced in a number of limited sizes so as to be able to be used, each one, by users having foot sizes which are slightly different.

This however forces the user to buy a size which does not correspond to the exact dimensions of his own foot, forcing him or her to employ other expedients, such as for example the use of socks of increased thickness, for increasing comfort and for allowing thus to transmit in an optimum manner the forces from the foot to the ski.

Such drawback is greater in the case of users which are children, whose foot typically has dimensions which increase in relatively short times.

Another problem which should be held in mind is the fact that to a fixed size there corresponds a fixed shape of the calf of the user, for which the use of larger sizes and the compensation of the greater space for the foot with a sock may bring about localized areas of compression of the upper end of the cuff on the calf.

SUMMARY OF THE INVENTION

The aim of the present invention is to solve the above cited problems, eliminating the cited drawbacks of the known art, by providing a ski boot which adapts to the specific sizes not only of the foot of the user but also of his/her calf.

Within this aim, an object of the invention is to provide a ski boot which may be used also by a child maintaining over time a good comfort for the foot and leg even following a slight dimensional increase of the foot itself.

Another object is to provide a ski boot which may be used by a single user or by more users having similar dimensions of the foot and of the calf, so as to find, for example, great use in the sector of rentals.

Another object is to provide a ski boot in which the adaptability to the dimensions of the foot and of the calf are obtainable in a quick and easy manner on the part of the user.

A not least object is to provide a ski boot which is structurally simple and has relatively low costs.

This aim and these and other objects which will better appear hereinafter, are achieved by a ski boot, comprising a rigid conventional-type sole, which is characterized in that from said sole there protrudes from the area of the forefoot and approximately up to the area of the arch of the foot, a shell, open in the direction of the area of the heel of said sole, thereat and to which there is rearwardly and slideably connectable a buttress element interacting with adjustment and guiding means of the axial position with respect to said sole and to which there is rotatably connectable a height-adjustable cuff.

BRIEF DESCRIPTION OF THE DRAWINGS

Further characteristics and advantages of the invention will become better apparent from the following detailed description of a particular but not exclusive embodiment thereof, illustrated only by way of non-limiting example in the accompanying drawings, wherein.

DESCRIPTION OF THE PREFERRED EMBODIMENTS

Figure 1:
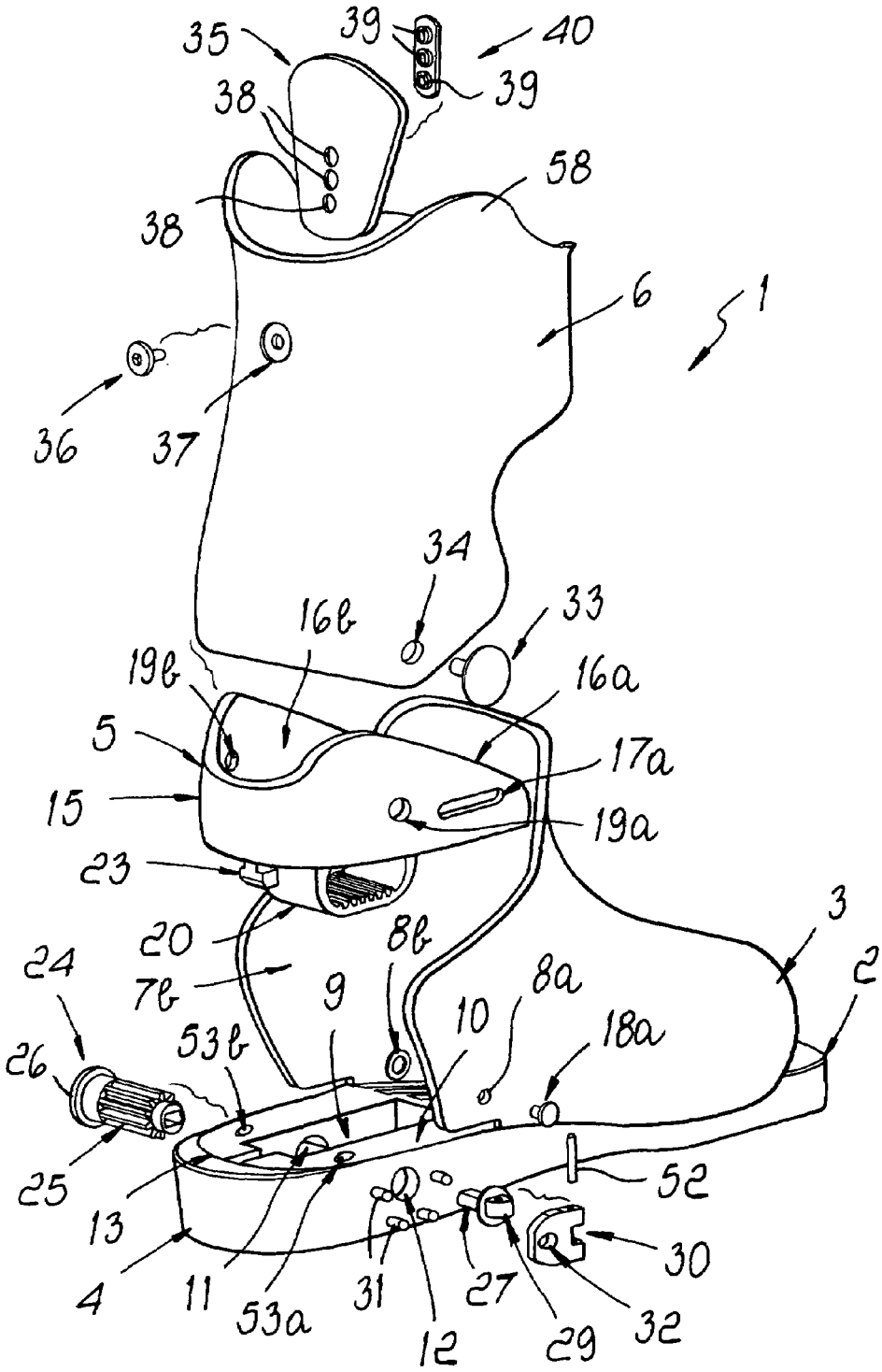
FIG. 1 is an exploded perspective view of a ski boot according to the invention.
Figure 2:
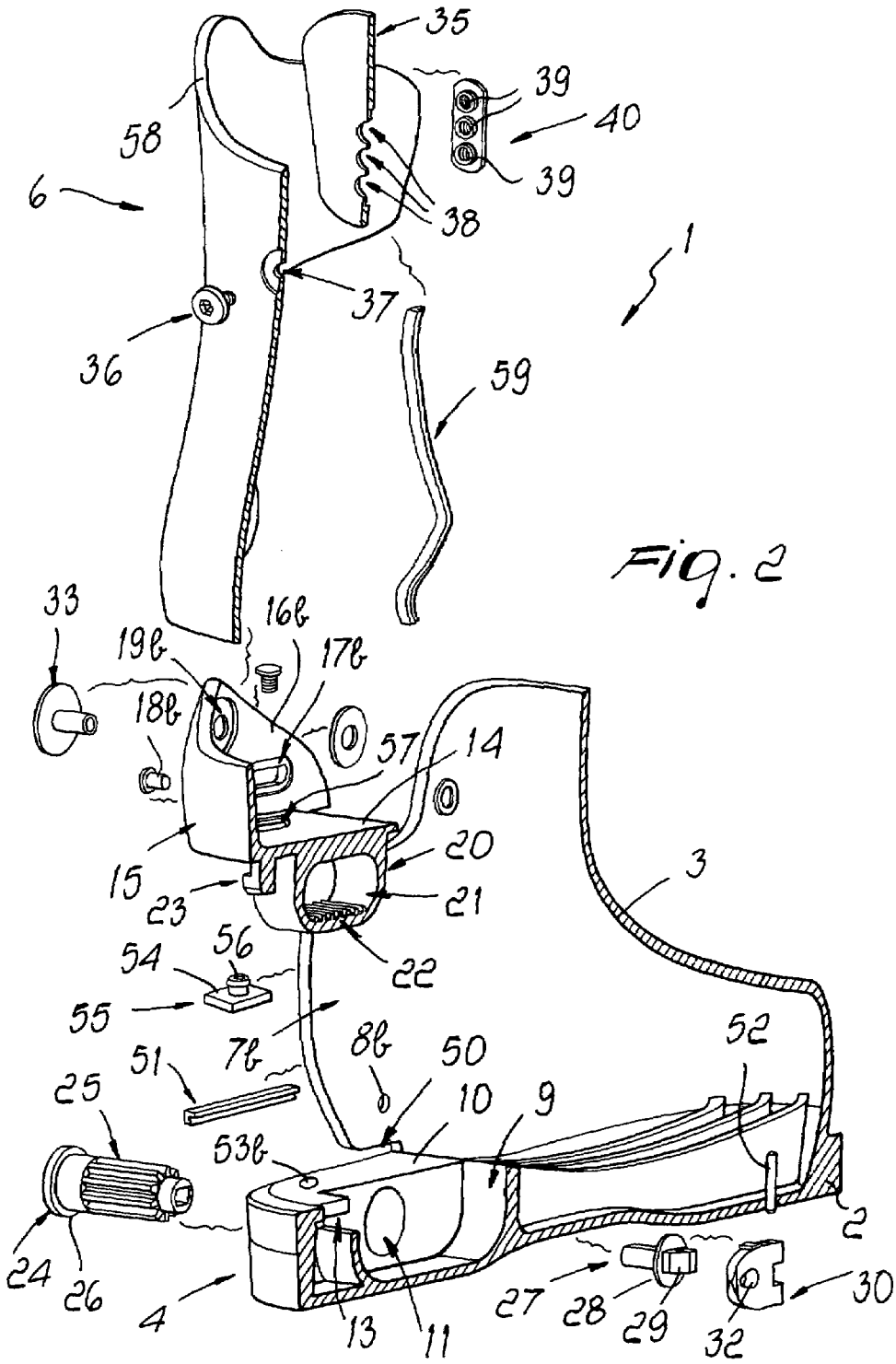
FIG. 2 is, for illustrated clearness, a partial longitudinal section, exploded perspective view, of the ski boot according to the invention.
Figure 3:
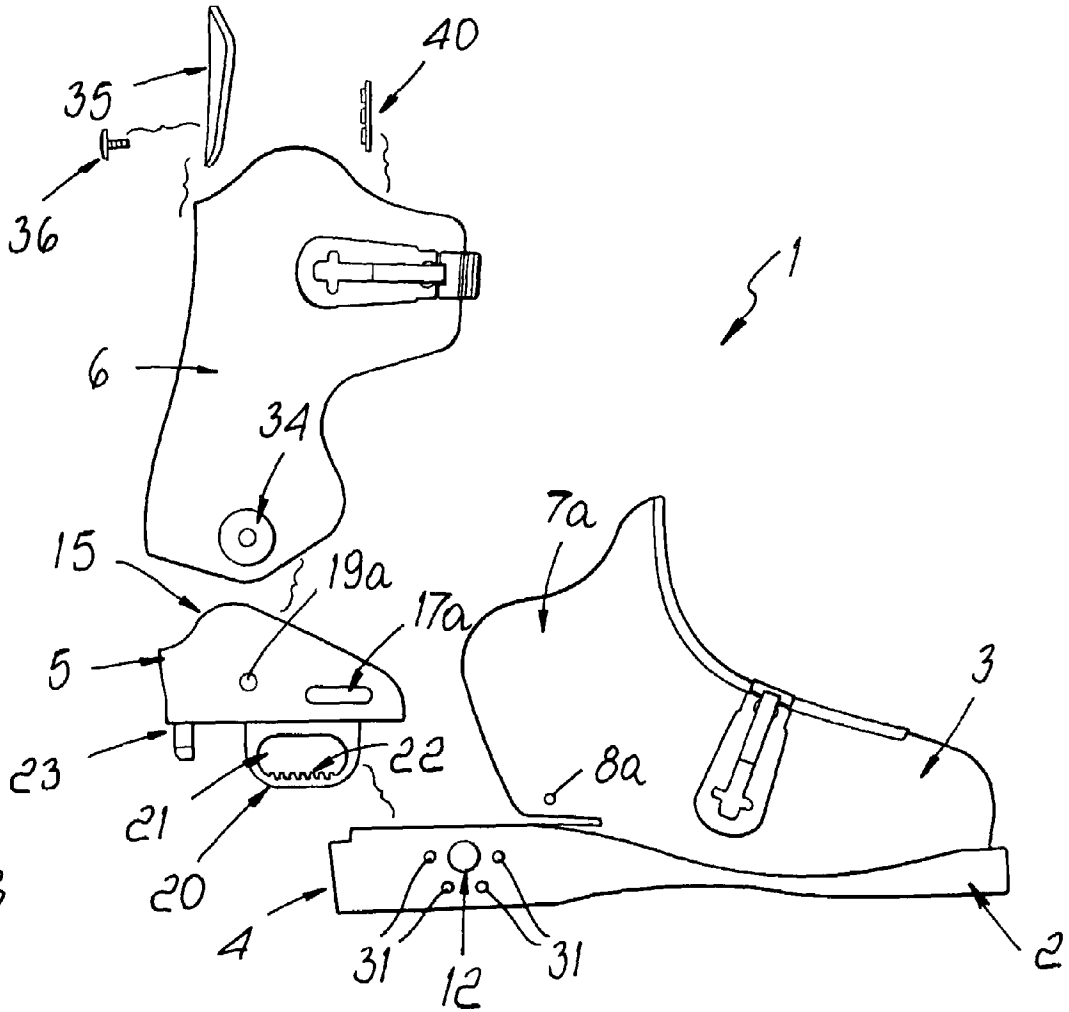
FIG. 3 is an exploded side view of various components of the ski boot according to the invention.
Figure 4:
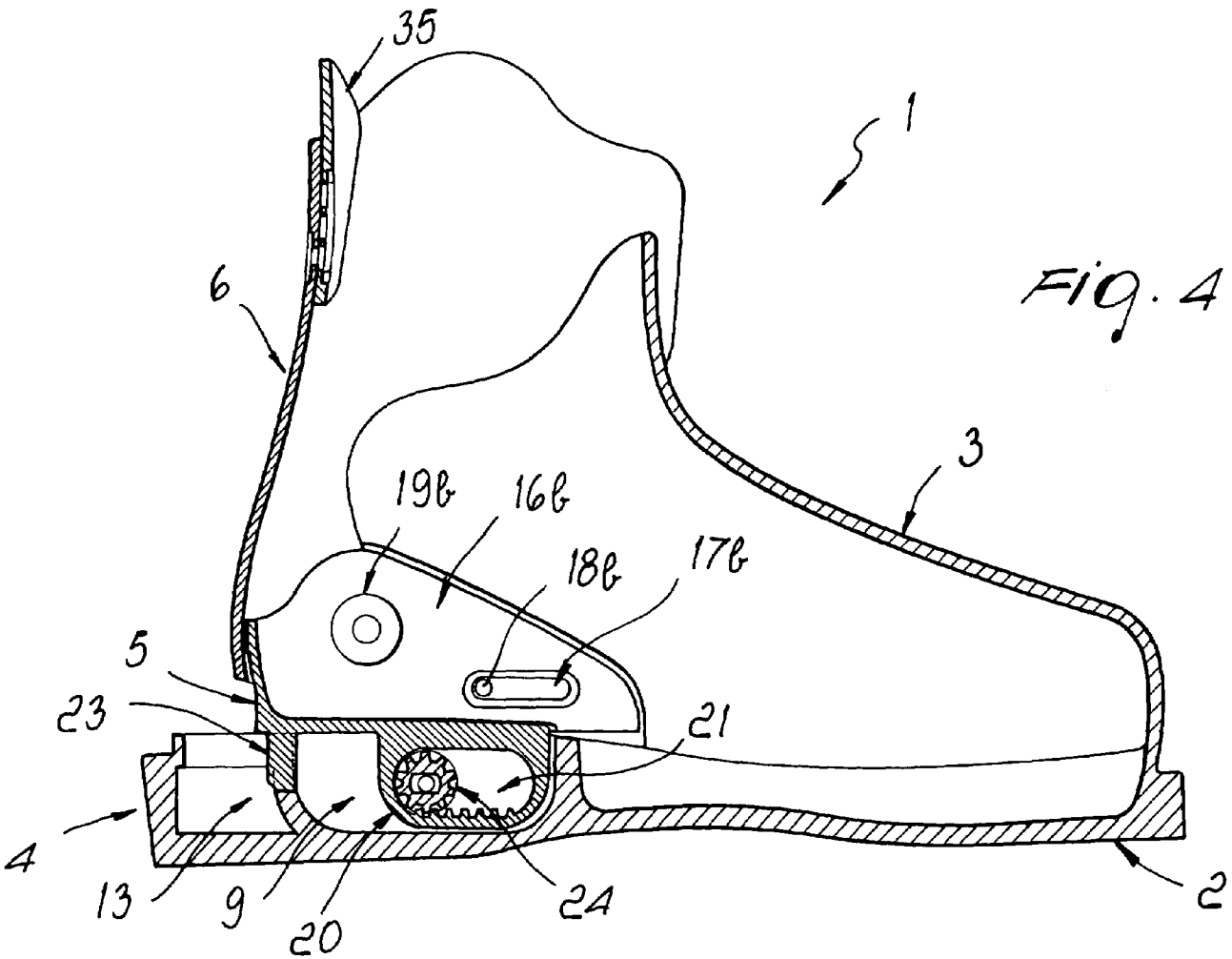
FIG. 4 is a sectional view taken along a medium longitudinal plane of the ski boot according to the invention in a minimum-length configuration.
Figure 5:
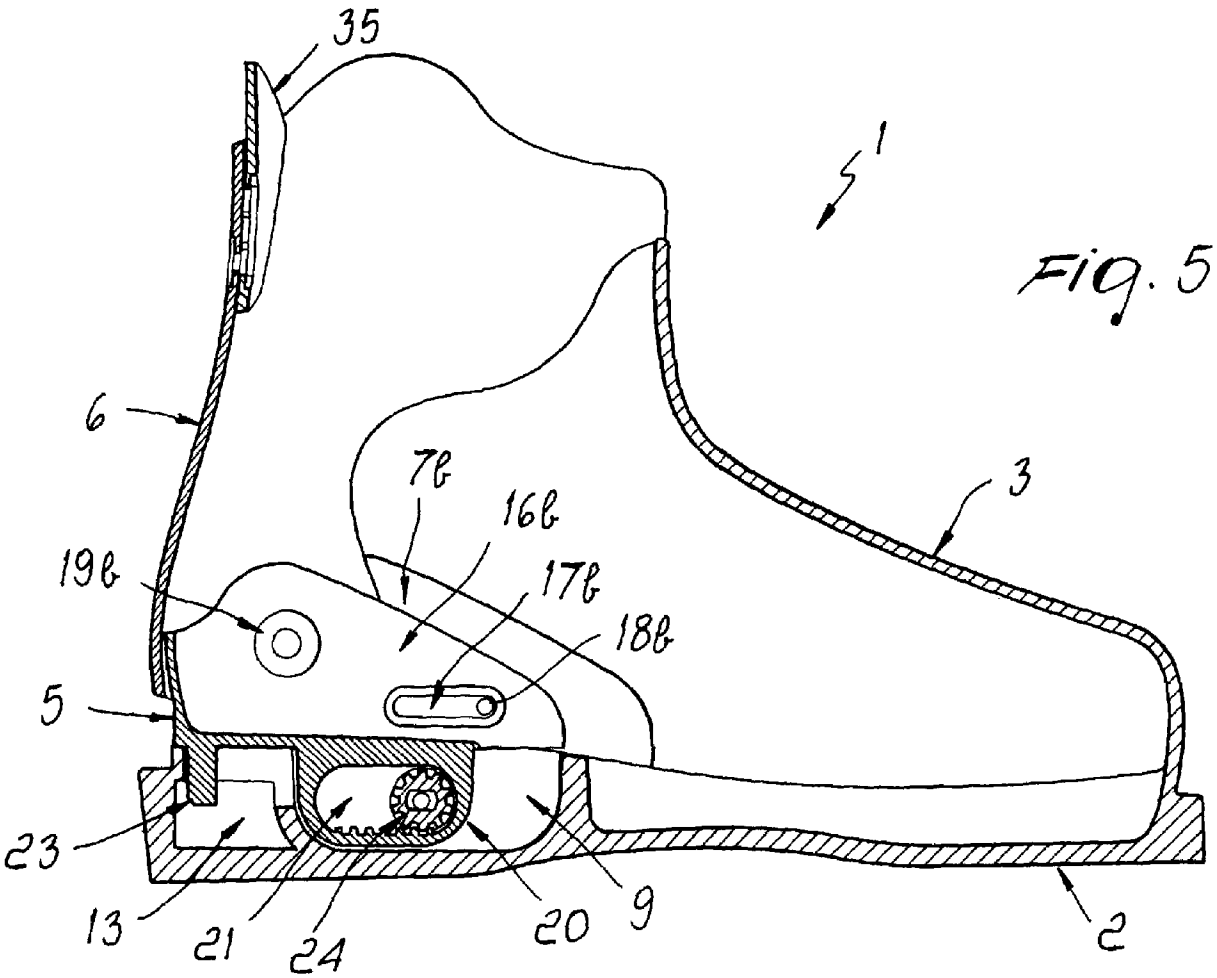
FIG. 5 is a view similar to FIG. 4 of the ski boot in a maximum-length configuration.

In the following embodiments, single characteristics, in relation to specific embodiments, in reality may be interchanged with other different characteristics of other embodiments.

Moreover, it is to be noted that everything found to be known during the patenting procedure is not intended to be claimed and subject to a disclaimer from the claims.

With reference to the figures, the reference numeral 1 indicates a ski boot comprising a rigid conventional-type sole 2.

From the sole 2 there protrudes, from the area of the forefoot and approximately up to the area, i.e. up to the region, of the arch of the foot, a shell, provided typically in plastic material, rigid or semirigid, open in the direction of the area of the heel 4 of the sole 2; to the shell there is rearwardly and slidably connectable, at the area of the heel 4 of the sole 2, a buttress element 5, interacting with adjustment and guiding means of its axial position with respect to said sole. To said buttress element 5 there is rotatably connected a cuff 6.

The shell 3 has two lateral wings 7*a* and 7*b*, which protrude approximately starting from the area of the arch of the foot, above the sole 2 and in a direction of the malleoli of the user; the wings 7*a* and 7*b* have, in proximity to the lower edge 50 adjacent the sole 2, two first holes, indicated respectively with the numbers 8*a* and 8*b*, obtained on the same axis, transverse to the sole 2.

The above mentioned means for adjusting the axial position with respect to the sole 2 comprise a first seat 9 provided in the sole 2 at the area of the heel 4 of the sole, starting from the upper surface 10 of the sole.

Such first seat 9 has, in top plan view, an approximately rectangular shape, which extends in length in the longitudinal axial direction of the sole 2.

There are provided, at the mutually facing longitudinal lateral surfaces of the first seat 9, according to the same axis, respectively a second hole 11 and a third hole 12; advantageously the second hole 11 has a diameter greater than that of the third hole 12.

The first seat 9 communicates with a rear cavity 13, which is part of said guiding means of the axial position with respect to the sole 2, and which is provided, starting from the upper surface 10 of such sole, in the part which extends from the first seat 9 to the rear perimetral border of the sole 2; the cavity 13 is shaped, in transverse cross-section, substantially as having the general configuration of an inverted T, and has in top plan view approximately a rectangular shape, with a width and length advantageously less than those of the first seat 9.

The buttress element 5 comprises a base 14, substantially flat, and slidable in use on the upper surface 10 of the sole, in the area of the first seat 9 and the cavity 13; the base 14 has in top plan view a profile which partially corresponds to that of the sole 2 in the area of the heel 4.

Advantageously between at least part of the upper surface 10 of the area of the heel 4 and the lower surface of the longitudinal perimetral edges of the buttress element 5 there is interposed a first snow-guard or water-guard comprising a first strip 51, in appropriate material, which is advantageously L-shaped and is arranged at least at an end in the interspace present between the upper surface 10 and the lower edge 50 of the wings 7*a* and 7*b*.

From the perimetral edge of the base 14 there extends, from the opposite side of the sole 2, a first appendix 15, having in top plan view a substantially U-shape to define two lateral walls, indicated respectively with the numbers 16*a* and 16*b*, slidably positionable in use, and internal to the wings 7*a* and 7*b* of the shell 3.

Advantageously on the walls 16*a* and 16*b* there are provided, along longitudinal axes of the sole 2, respectively two first slots, indicated with the numbers 17*a* and 17*b*, respectively arranged facing, in use, the first holes 8*a* and 8*b* provided in the wings 7*a* and 7*b* of the shell 3; such first holes 8*a* and 8*b* and first slots 17*a* and 17*b* constitute said guiding means of the axial position with respect to said sole.

The first holes 8*a* and 8*b* are slidably connected to the first slots 17*a* and 17*b* by means of first screws or rivets, indicated by the numbers 18*a* and 18*b*, fixed in such first holes 8*a* and 8*b* and slidably inserted in the same first slots 17*a* and 17*b*; such first screws or rivets 18*a* and 18*b* also constitute the above-mentioned guiding means of the axial position with respect to the sole 2.

On the walls 16*a* and 16*b* there are also provided, above the first slots 17*a* and 17*b* and distally therefrom in the direction opposite to the shell 2 two fourth through holes having the same axis and indicated respectively with the numbers 19*a* and 19*b*.

Substantially perpendicularly to the base 14 there extends, towards the sole 2, a second appendix 20, constituting said adjusting and guiding means of the axial position with respect to the sole 2, slidably positionably at the first seat 9 provided on the upper surface 10 of the sole 2.

The second appendix 20 has a width approximately equal to that of the first seat 9 and a length less than the same, so as to be able to longitudinally move inside such first seat according to a desired path; advantageously the second appendix 20 has, in a longitudinal cross-section, an approximately oval shape and such second appendix 20 is transversally provided with a second through seat 21.

At the upper surface or, preferably, at the lower surface of such second seat 21, there is provided a toothing 22 which is transverse to the same second appendix 20.

From the base 14 there extends, towards the sole 2 and rearwardly from the second appendix 20, a third appendix 23, shaped substantially like the cavity 13 and having a longitudinal extension less than such cavity, slidably lodged in such cavity 13 for guiding and limiting the sliding of the buttress element 5 longitudinally to the sole 2; the second appendix 20 constitutes said guiding means of the axial position with respect to the sole 2.

Inside the second seat 21 there is positionable a further component for the above-mentioned adjustment means of the axial position with respect to the sole 2, such component being constituted by a second screw 24 having a first cylinder or shank 25, axially counter-toothed to the toothing 22 and engageable therewith; the second screw 24 is rotatably positionable at the second hole 11 and the third hole 12.

The second screw 24 has, at an end adjacent the second hole 11, an annular head 26 having a diameter greater than that of the second hole 11 so as to abut on the perimetral edge of such second hole 11 and having the possibility of freely rotating.

The free end of the second screw 24 protrudes from the third hole 12 and is rotatably connected therewith by means of the axial keying of a pin 27 supporting a disk 28 having a diameter greater than that of the third hole 12, so as to abut with the perimetral edge of such third hole.

From the disk 28 there protrudes, from the part opposite the pin 27, a support element 29 to which there is hinged, by means of a first small pin 52, a lever 30, adapted to allow to impart the desired rotation to the second screw 24 on the part of the user.

The lever 30 is in turn tippable against the lateral surface of the sole 2 and is thereby connectable to such sole, in a desired position, by means of the insertion of predisposed second small pins 31, protruding approximately perpendicularly from the lateral surface of the sole 2, in a fifth through hole 32 provided in such lever 30.

To the buttress element 5 there is rotatably connected the cuff 6, positioned to partially wrap around the first appendix 15 of the same buttress element 5 and pivoted thereto by means of the insertion of predisposed studs 33 in sixth holes 34 provided in the cuff approximately at the fourth holes 19*a* and 19*b* and therefore also inserted in such fourth holes.

The cuff 6 is adjustable in height thanks to the presence of a small tongue 35 which may be selectively made to protrude from the rear area of the upper perimetral edge 58 of the cuff itself; the tongue 35 is connectable to the cuff 6, in a desired vertical position, by means of the insertion of a third screw 36 in a sixth hole 37 provided on the cuff 6 in proximity to the upper perimetral edge 58, and therefore in one of two or more sixth holes 38 provided longitudinally to the tongue 35 itself.

The connection is provided by means of the interaction of such third screw 36 with one of more third counter-shaped seats 39, provided in a plate element 40 connectable to the tongue 35 on the opposite side of said cuff 6.

To constitute a further guiding means of the axial position of the buttress element 5 with respect to the sole 2 there is also provided, at the upper surface 10 of the area of the heel 4, seventh holes 53*a* or 53*b* provided laterally to the first seat 9 and downwardly communicating with third seats, not illustrated, adapted to house the head 54, advantageously polygonally shaped, of a fourth screw or rivet 55.

This latter has a second cylinder or shank 56 which is slidably positionable inside second slots 57 provided on the base 14 of the buttress element 5 and connected to the second cylinders 56.

A second snow-guard or water-guard is constituted by a second strip 59, connected to the perimetral edges of the cuff 6 facing the merging perimetral edges of the wings 7*a* and 7*b* of the shell 3.

The use of the invention is therefore as follows: with reference to the attached drawings, the buttress element 5 is connected to the sole 2 and to the shell 3 providing the second appendix 20 and the third appendix 23 respectively in the first seat 9 and in the cavity 13, and contemporarily positioning the walls 16*a* and 16*b* inside the wings 7*a* and 7*b* of the shell 3.

The first screws or rivets 18*a*, 18*b* are positioned respectively in the first holes 8*a* and 8*b* and therefore in the first slots 17*a* and 17*b*, in such manner to slidably connect the buttress element 5 to the shell 3.

The first cylinder 25 of the second screw 24 is therefore inserted, through the second hole 11, in the first seat 9 and in the second seat 21, to be positioned with its ends respectively at the second hole 11 and at the third hole 12; keying the pin 27 in the cylinder 25 of the second screw 24, this latter, due to the engagement of the head 26 and of the disk 28 respectively with the perimetral edge of the second hole 11 and of the third hole 12, is therefore connected to the sole 2.

The first toothed cylinder 25 of the second screw 24 is therefore engaged in the toothing 22 present in the second seat 21. At this point the cuff 6 may be positioned to wrap around the walls 16*a* and 16*b* of the first appendix 15 of the buttress element 5 of the shell 3, and therefore connected to the same by means of the insertion of the lugs 33 in the sixth holes 34 and in the fourth holes 19*a*, 19*b*.

Acting on the lever 30, the user may rotate the second screw 24 to the desired angle, in such manner advancing or rearwardly moving the buttress element 5 with respect to the shell 3, and obtaining thereby the elongation or the shortening of the boot 1.

Once the desired length has been obtained, it is possible to block the mutual sliding of the shell 3 and buttress element 5 by rotating the lever 30 towards the lateral surface of the sole 2 and fixing it thereto by means of the introduction of one of the small pins 31 in the fifth hole 32 provided in the lever 30 itself.

In such a manner it is therefore possible to obtain a very fine adjustment of the length of the ski boot 1.

Inside the ski boot 1 there may eventually be disposed an inner boot, not shown in the accompanying drawing figures, in soft material adapted to increase the comfort-fit for the user.

It is seen how the invention has reached the above-described aim and objects, there being provided a ski boot which, thanks to the possibility of adjusting both the length of the shell and the height of the cuff, is adaptable in an optimum manner to the specific dimensions of the foot and of the leg of the user, guarantee to the same an high comfort-fit.

Moreover, the ski boot according to the invention may be used for long periods even by children, since the dimensions of the boot may be changed in time to adapt to the dimensional growth of the foot and of the leg of the child.

Furthermore the ski boot according to the invention, thanks to the possibility to adjust rapidly in a desired moment the length of the shell and the height of the cuff, may be used by a plurality of users having similar, but not identical, dimensions of the foot and of the leg, so as to be, for example, largely employable in the rental sector.

Moreover, the size adjustment is obtainable in an easy and rapid fashion on the part of the user, without the need of particular tools or of dismounting of any part constituting the boot.

The terms approximately and substantially are intended to mean that the features to which they are referring have the characteristics they designate but for shape or size tolerances within the true values generally known in the art.

Naturally, the invention is susceptible to numerous modifications and variations, all of which fall within the scope of the appended claims.

Naturally, the materials employed as well as the dimension of the single components of the invention may be more pertinent according to specific requirements.

The different means for carrying out certain different functions certainly must not coexist only in the illustrated embodiment, but may be per se present in many embodiments, also not illustrated.

The characteristics indicated as advantageous, suitable, or similar, may also be lacking or substituted by equivalents.

The disclosures in Italian Patent Application No. TV2005A000053 from which this application claims priority are incorporated herein by reference.

What is claimed is:

1. A ski boot, comprising a rigid sole including a forefoot area, a foot arch area and a heel area; a shell protruding from said sole and extending between the forefoot area and up to the foot arch area of the sole; said shell being open in a direction of the heel area of said sole; a buttress element that is rearwardly and slideably connected to said shell at said open heel area thereof; adjustment and guiding means interacting with said buttress element for adjusting axial position thereof with respect to said sole; and a height-adjustable cuff, said height-adjustable cuff being rotatably connected to said buttress element.

2. The ski boot of claim 1, wherein said shell has two lateral wings which extend starting from said foot arch area, in a direction of a user's malleoli, said wings having, in proximity to a lower edge thereof adjacent the sole, two first holes, arranged on a same axis, transverse to said sole.

3. The ski boot of claim 2, wherein said means for adjusting the axial position with respect to the sole comprise a first seat provided in the sole in proximity to the heel area, starting from an upper surface thereof, said first seat having in top plan view a rectangular shape, which extends in length in a longitudinal axial direction of said sole.

4. The ski boot of claim 3, comprising a second and a third holes provided at mutually facing longitudinal lateral surfaces of said first seat, said second and third holes having a same axis.

5. The ski boot of claim 4, wherein said second hole has a diameter greater than that of said third hole.

6. The ski boot of claim 5, comprising a rear cavity which is part of said guiding means of the axial position with respect to the sole, and is provided, starting from the upper surface of said hole, in a part which extends from said first seat to the rear perimetral border of said sole, said first seat communicating with the rear cavity.

7. The ski boot of claim 6, wherein said cavity is shaped, in transverse cross-section, as an inverted T, and has in top plan view a rectangular shape, with a width and length less that those of said first seal.

8. The ski boot of claim 7, wherein said buttress element comprises a base, substantially flat, and slidable in use on said upper surface of said sole, in an area of said first seat and said cavity, said base having in top plan view a profile which partially corresponds to that of said sole in the heel area thereof.

9. The ski boot of claim 8, comprising a first appendix that extends from the perimetral edge of said base, from an opposite side of said sole, said first appendix, having in top plan view a substantially U-shape defining two lateral walls, slidably positionable in use, and internal to said wings of said shell.

10. The ski boot of claim 9, comprising: two first slots provided on said walls, along longitudinal axes to said sole, said two first slots being respectively arranged facing, in use, said first holes of said wings of said shell; first screws or rivets, said first holes being slidably connectable to said first slots by way of said first screws or rivets, fixed in said first holes and slidably inserted in said first slots themselves, said first holes, said first slots, and said first screws or rivets constituting said guiding means of the axial position with respect to said sole.

11. The ski boot of claim 10, further comprising two fourth through holes having a same axis that are provided on said walls, above said first slots and distally therefrom in the direction opposite to said shell.

12. The ski boot of claim 10, further comprising a second appendix extending perpendicularly to said base, towards said sole, said second appendix constituting said adjusting and guiding means of the axial position with respect to said sole, and being slidably positionably at said first seat provided on said upper surface of said sole, said second appendix having further a width substantially equal to that of said first seat and a length less than the same, and having, in a longitudinal cross-section, an oval shape.

13. The ski boot of claim 12, comprising a toothing which is transverse to said second appendix and is provided at any of an upper surface or lower surface of said second seat, said second appendix being transversally provided with a second through seat.

14. The ski boot of claim 13, comprising a third appendix extending from said base, towards said sole and rearwardly from said second appendix, said third appendix being shaped like said cavity with a longitudinal extension less than such cavity, and being slidably engageable in said cavity for guiding and limiting sliding of said buttress element longitudinally to said sole, said second appendix constituting said guiding means of the axial position with respect to said sole.

15. The ski boot of claim 14, wherein said adjustment means of the axial position with respect to said sole comprise a second screw, positionable within said second seat, having a first cylinder axially counter-toothed to said toothing and engageable therewith, said second screw being rotatably positionable at said second hole and said third hole.

16. The ski boot of claim 15, comprising a pin supporting a disk having a diameter greater than that of said third hole, so as to abut with a perimetral edge of said third hole, said second screw having, at an end adjacent said second hole, an annular head having a diameter greater than that of said second hole so as to abut on the perimetral edge of said second hole for free rotation, a free end of said second screw protruding from said third hole and being rotatably connected therewith by way of the axial keying of said pin.

17. The ski boot of claim 16, comprising: a support element protruding from said disk, from a part opposite said pin; a small pin; second small pins; a lever with a fifth hole; and a support element to which is hinged, by way of the first small pin, the lever which is adapted to allow to impart a desired rotation to said second screw by a user, said lever being tippable against a lateral surface of said sole and being thereby connectable to such sole, in a desired position, by insertion of said second small pins, protruding perpendicularly from said lateral surface of said sole, in the fifth through hole provided in said lever.

18. The ski boot of claim 17, said cuff is adjustable in height by way of a small tongue adapted to be selectively made to protrude from a rear area of the upper perimetral edge of said cuff.

19. The ski boot of claim 18, comprising a third screw, sixth holes, and third counter shaped seats, said tongue being connectable to the cuff; in a desired vertical position, by insertion of the third screw in one of the sixth holes provided on said cuff in proximity to said upper perimetral edge, and therefore in one of two or more sixth holes provided longitudinally to said tongue itself, the connection being provided by interaction of said third screw with one more of the third counter-shaped seats, which are provided in a plate element connectable to said tongue on the opposite side of said cuff.

20. The ski boot of claim 9, comprising a first snow or water-guard interposed between at least part of said upper surface of said heel area and said lower surface of the longitudinal perimetral edges of said buttress element, said first snow-guard or water-guard being constituted by a first strip, in appropriate material, which is L-shaped and arranged at least at an end in an interspace present between said upper surface and lower edge of said wings of said shell.

21. The ski boot of claim 19, comprising a fourth screw or rivet with a head, and seventh holes that constitute a further guiding means of the axial position of said buttress element with respect to said sole and provided, at said upper surface of said area of the heel, said seventh holes being further provided laterally to said first seat and downwardly communicating with third seats adapted to house the head, polygonally shaped, of the fourth screw or rivet.

22. The ski boot of claim 21, wherein said fourth screw or rivet is slidably positionable inside second slots provided on said base of said buttress element and connected to said second cylinders themselves.

23. The ski boot of claim 20, comprising a second snow-guard or water-guard constituted by a second strip connected to the perimetral edges of said cuff facing the merging perimetral edges of said wings of said shell.

* * * * *